US005868264A

United States Patent [19]

Fulford et al.

[11] Patent Number: 5,868,264

[45] Date of Patent: Feb. 9, 1999

[54] FORMED AND DECORATED SEAL

[75] Inventors: Gregory P. Fulford, Los Altos, Calif.; Richard H. Swain, Peoria, Ill.; Douglas P. Ward, Napa; Judy A. Zeigler, Richmond, both of Calif.

[73] Assignee: Fleming Packaging Corporation, Peoria, Ill.

[21] Appl. No.: 933,279

[22] Filed: Sep. 18, 1997

[51] Int. Cl.[6] ..... B65D 39/00

[52] U.S. Cl. ..... 215/232; 215/251; 215/364

[58] Field of Search ..... 215/230, 232, 215/233, 251, 273, 296, 297, 298, 299, 300, 363, 364; 220/257, 258, 359

[56] References Cited

U.S. PATENT DOCUMENTS

| | | | |
|---|---|---|---|
| 368,959 | 8/1887 | Morehouse . | |
| 491,433 | 2/1893 | Lynn . | |
| 518,277 | 4/1894 | Robinson | 215/251 |
| 587,368 | 8/1897 | Jackson . | |
| 724,794 | 4/1903 | Brewington | 215/273 |
| 827,665 | 7/1906 | Quick . | |
| 882,912 | 3/1908 | Robinson . | |
| 1,116,663 | 11/1914 | Woodruff . | |
| 1,222,765 | 4/1917 | Hudson . | |
| 1,294,220 | 2/1919 | Arnheim . | |
| 1,303,212 | 5/1919 | Knight et al. . | |
| 1,481,034 | 1/1924 | Stattmann . | |
| 1,612,144 | 12/1926 | Müller et al. . | |
| 1,644,542 | 10/1927 | Pease | 215/273 |
| 1,654,720 | 1/1928 | Clark . | |
| 1,686,238 | 10/1928 | Julius | 215/273 |
| 2,338,102 | 1/1944 | Fields . | |
| 2,666,542 | 1/1954 | Price . | |
| 2,734,649 | 2/1956 | Callahan et al. . | |
| 2,799,981 | 7/1957 | Baker-Carr et al. . | |
| 3,827,591 | 8/1974 | Spelman et al. . | |
| 3,924,771 | 12/1975 | Cleff . | |
| 4,260,438 | 4/1981 | Dembicki et al. . | |
| 4,266,687 | 5/1981 | Cummings . | |
| 4,297,161 | 10/1981 | Graffin . | |
| 4,301,266 | 11/1981 | Muenster et al. . | |
| 4,318,490 | 3/1982 | Schneider . | |
| 4,324,601 | 4/1982 | Dembicki et al. . | |
| 4,389,266 | 6/1983 | Dembicki et al. . | |
| 4,421,580 | 12/1983 | Dembicki et al. . | |
| 4,442,129 | 4/1984 | Niwa et al. . | |
| 4,588,465 | 5/1986 | Paciorek . | |
| 4,708,242 | 11/1987 | Reid et al. . | |
| 4,771,903 | 9/1988 | Levene et al. . | |
| 4,801,037 | 1/1989 | Hayashida et al. . | |
| 4,842,140 | 6/1989 | Mesnard . | |
| 5,119,964 | 6/1992 | Witt . | |
| 5,261,547 | 11/1993 | Finke . | |
| 5,447,246 | 9/1995 | Finke . | |
| 5,449,080 | 9/1995 | Finke . | |
| 5,522,200 | 6/1996 | Foldesi et al. . | |
| 5,533,317 | 7/1996 | Galandrino . | |
| 5,553,728 | 9/1996 | Finke | 215/233 |
| 5,636,958 | 6/1997 | Foldesi et al. . | |
| 5,779,073 | 7/1998 | Milhomme | 215/232 |

*Primary Examiner*—Stephen K. Cronin
*Attorney, Agent, or Firm*—Banner & Witcoff Ltd

[57] ABSTRACT

A closure assembly for wine bottles includes a bottle having a cylindrical opening in the neck, a funnel shaped surface connecting to the cylindrical opening and a flat planar rim on the outside of the bottle. A secondary closure in the shape of an inverted hat fits over the rim and engages a glass by means of a thermoplastic adhesive.

6 Claims, 1 Drawing Sheet

FORMED AND DECORATED SEAL

BACKGROUND OF THE INVENTION

This invention relates to a closure assembly for a bottle, and in particular, wine bottles. The invention also contemplates a novel secondary closure construction.

The wine industry has, for generations, utilized a wine bottle wherein a cork served as a primary closure. Various devices were then utilized to provide a secondary closure or cover for the cork and bottle opening into which the cork is fitted. Morehouse, in Patent No. 368,959, discloses a bottle stopper construction of the type which could possibly be used in the environment described. Quick, in Patent No. 827,665, discloses yet another construction. Additional references include the following: U.S. Pat. No. 1,116,663 (Woodruff), U.S. Pat. No. 1,222,765 (Hudson), U.S. Pat. No. 1,481,034 (Stattmann), U.S. Pat. No. 1,612,144 (Muller et al.), U.S. Pat. No. 1,654,720 (Clark), U.S. Pat. No. 2,338,102 (Fields), U.S. Pat. No. 2,665,542 (Price), U.S. Pat. No. 3,827,591 (Spelman et al.), U.S. Pat. No. 5,261,547 (Finke), U.S. Pat. No. 5,447,246 (Finke) and U.S. Pat. No. 5,449,080 (Finke).

Of the above references, attention is specifically drawn to Price, U.S. Pat. No. 2,665,542, wherein a stopper is fitted into the neck of a bottle and covered with a foil cap. Also, reference is directed to Spelman et al., U.S. Pat. No. 3,827,591, which discloses a bottle wherein a cork is positioned in the neck of the bottle as a primary closure and a secondary closure comprises a foil cap.

Recent developments in the wine industry suggest that the primary closure be covered with a thermoplastic wax material as a secondary closure. The thermoplastic wax material is fitted into the neck over the primary closure. Finke, U.S. Pat. No. 5,261,547, and U.S. Pat. No. 5,447,246 as well as U.S. Pat. No. 5,449,080 are examples of this approach.

Nonetheless, there has remained a need to develop a secondary and primary closure assembly for a wine bottle which has improved aesthetics, provides the function of a secondary closure to cover the neck of the bottle as well as the primary closure and, finally, which is easily removable and perhaps indicates a tamper-proof arrangement. Thus, heretofore, wine containers and bottles had a decorative capsule covering both the bottle neck and the primary closure or a cork. The recent introduction of disks made of paper, wax or a combination of paper and wax used to seal the area on the top of the cork exposed to the outside of the bottle typically fitted within the neck of the bottle. They may provide a decorative appearance.

There are various problems associated with these methods. For example, lead capsules are not used due to the potential for exposure to lead. Aluminum foil laminated capsules or plastic capsules are difficult to remove, in some cases do not have a pleasing appearance and may occasionally cause finger cuts. The use of a wax plug on top of the primary closure provides a construction which is difficult to remove and which may shatter during removal. Paper or wax may bond too tightly to the cork, again making it difficult to remove. On occasion, when consumers remove a paper or wax covered cork, they will invert the cork and put the paper or wax into the bottle if all the fluid from the bottle is not consumed. The paper or wax may then undesirably come into contact with the contents of the bottle, or the seal may fall into the bottle and subsequently become ingested by a consumer. Restaurants also complain that wax particles are unsightly on tablecloths and tend to stain tablecloths, carpet and wait staff garments. Wax also tends to be less tamper evident as the wax and cork can be removed using a two-prong style cork remover without leaving some evidence of tampering.

Thus there has remained a need for an improved closure assembly, and more particularly, a closure assembly which utilizes an improved secondary closure, particularly in the wine industry.

SUMMARY OF THE INVENTION

The present invention is a closure assembly for glass wine bottles of the type which have a neck with a cylindrical opening into which a cork may be positioned as a primary closure. The secondary closure of the invention comprises a formed foil material which includes a thermoplastic coating that adheres to the glass around the opening. The bottle also has a unique opening configuration. That is, a planar rim connects with an optional circumferential recess, that connects to a frustoconical surface that then leads into the cylindrical opening in which the primary closure or cork is positioned. The secondary closure has a compatible configuration; namely, an outer annular flat rim connected with a funnel shaped frustoconical section that encircles a central or plate portion. The central or plate portion is generally congruent with the top of the cork in the cylindrical opening in the bottle. The frustoconical section or funnel shaped section of the foil or secondary closure is generally compatible with and congruent with the funnel shaped opening in the top end of the wine bottle. The flat annular outer rim or section of the foil fits over the top surface of the bottle or in a recess in the top of the bottle. Thus, the secondary closure has an inverted top hat shape generally congruent with the shape formed by the bottle opening and the position of the primary closure therein. The arrangement provides for automatic centering of the secondary closure over the primary closure. The secondary closure may include printed graphics, an embossed or raised surface, or a hot foil stamped image thereon for aesthetic and labeling purposes. Thus, the secondary closure and the closure assembly provide a decorative as well as functional seal.

Thus it is an object of the invention to provide an improved closure assembly, especially for wine bottles.

It is a further object of the invention to provide an improved closure assembly comprised of a primary closure or cork which is fitted into an open end of a bottle, the bottle having a frustoconical or funnel shaped land or surface adaptable to receive a congruently defined surface of a secondary closure.

Yet a further object of the invention is to provide a secondary closure which may be easily positioned on an open end of a wine bottle, yet which may be easily removed without leaving any contamination materials on the bottle upon removal.

Yet another object of the invention is to provide a secondary closure which has a cross section that is congruent with the mouth or opening defined by a bottle and the primary closure positioned in the neck of the bottle.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
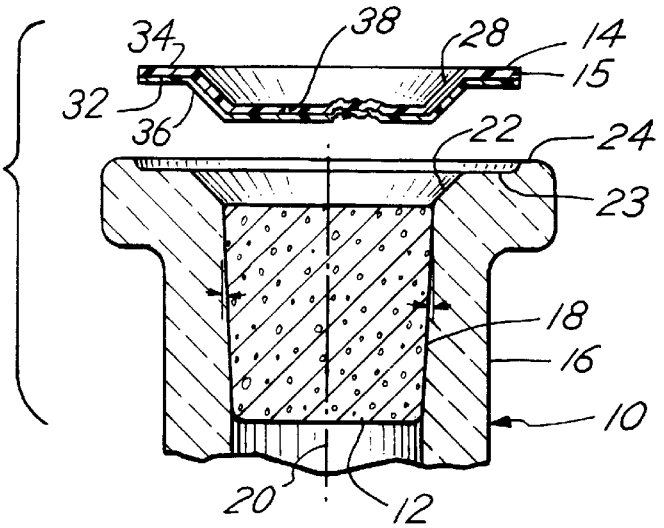
FIG. 1 is a side cross sectional elevation of the improved closure assembly of the invention including a primary closure, a wine bottle neck opening and a secondary closure.
Figure 2:
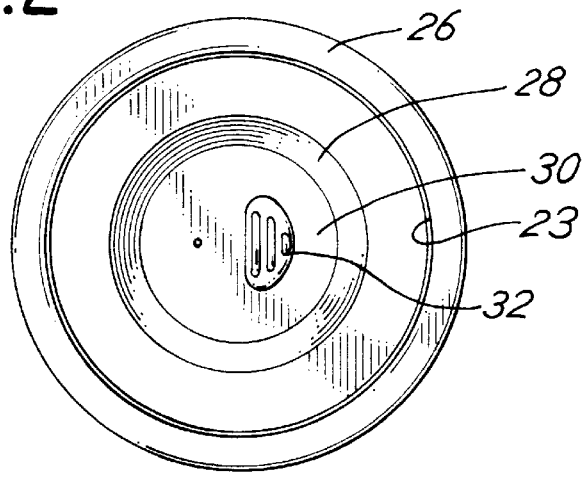
FIG. 2 is a top plan view of the secondary closure of the invention.

Referring to FIGS. 1 and 2, there is depicted in a cross sectional view, a bottle, and more particularly, the neck of a glass bottle 10 which includes a primary closure, in this circumstance a cork 12, and a secondary closure 14. Thus the bottle 10 includes a neck 16 which has a cylindrical passage or opening 18 therethrough defining a vertical axis 20. The cylindrical opening 18 receives a cylindrical cork 12. The cylindrical opening 18 connects with or joins directly into a funnel shaped or frustoconical shaped land or surface 22 which, in turn, connects with an annular recess or groove 23. A planar, flat top surface 24, that is generally transverse or perpendicular to the axis 20, connects with the recess or groove 23. The conical surface or land 22 forms an angle with the axis 20 in the range of 20 to 70 degrees. Preferably, the angle of inclination is in the range of 40 to 50 degrees. The transitions of glass material between opening 18, surface 22 and groove 23 have a radius rather than a sharp corner. The opening 18 may have a draft angle to facilitate entry of the cork 12.

Secondary closure 14 has an inverted top hat shape. The secondary closure 14 includes a layer of foil 15 with an outer annular circular rim 26, a connected frustoconical rib 28 within the rim 26 and a generally flat planar plate 30 within the rib 28. The plate 30 may be embossed, for example, embossment 32 may be placed in plate 30. Other indicia such as printing, a hot foil stamp image or the like may be provided on the plate 30. The foil layer 15 of the secondary closure 14 has an inside surface 32 and an outside surface 34. The inside surface 32 is coated with a thermoplastic adhesive material 36. Preferably, the thermoplastic adhesive material 36 coats at least the underside or inside of the rim 26 and rib 28. The underside of plate 30 may also be coated.

The foil layer 15 is preferably constructed of a thin aluminum alloy on the order of 0.002 inches, of a pre-colored or print primed aluminum foil. The foil 15 is bonded to a thin layer (0.002 inches) of a thermoplastic adhesive film or layer 36. The thermoplastic layer 36 may be either extruded or laminated to the foil 15. Typical thermoplastic materials are: extruded ionized polyolefin film or laminations made from such film. Typical aluminum foil materials are: continuous cast or direct cast aluminum of 1235, 1100, 1145 or 8111 alloy with thicknesses between 0.001 to 0.004 inches.

The foil 15 and adhesive film 36 combination or secondary closure 14 is decorated by various processes including flexographic, gravure, and letterpress printing. It is then stamped into the distinctive and functional yet ornamental shape of the inverted top hat depicted in FIG. 1. Note that the secondary closure 14 is self-centering on the container flange 24 and thus the opening 18. Note also that by having the particular configuration wherein a circular groove 23 is provided and the plate 30 is recessed, the graphics in the plate 30 are protected from abrasion or the like during shipping and handling. The groove 23 further enables maintenance of the rim 26, plate 30 and rib 28 in a protected, recessed position. The groove 23 of the bottle is an optional feature but is preferred.

The seal or secondary closure 14 is applied to the bottle neck 16 by the application of heat and pressure for a limited period of time to a closure positioned on the glass bottle neck. It is also to be noted that the plate 30 is preferably spaced from the primary closure 12 so that a small air space exists therebetween. Thus, in a preferred embodiment, the secondary closure 14 does not adhere to and does not touch the primary closure 12 and may also be spaced from land or surface 22. In operation, the secondary closure 14 may include a small passageway 38 through the plate 30 so that the space between the plate 30 and the primary closure 12 will remain at ambient pressure.

Figure 3:
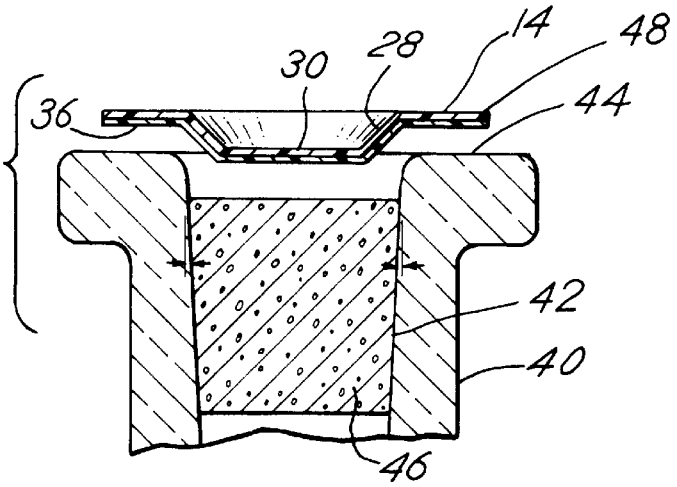
FIG. 3 is a side elevation of an alternative combination comprising the closure assembly of the invention utilizing the improved secondary closure construction.

FIG. 3 illustrates an alternative embodiment of the combination comprising the closure assembly. In the alternative embodiment a bottle neck 40 includes a cylindrical passage or opening 42 which connects directly with a transverse rim surface 44 though the glass transition is, again, typically radiused. There is no frustoconical or funnel shaped transition, but the passage 42 will typically have a draft to facilitate guidance of a cork 46 into the bottle neck. A primary closure or cork 46 is thus positioned within the cylinder 42. The secondary closure 48 is of a configuration, shape and size as previously described. However, the frustoconical portion or rib 28 does not mate against any particular surface. Rather it serves the function of positioning the plate 30 just above the cork 46. The thermoplastic layer 36 seals closure 14 to the surface 44. Again, the plate 30 is preferably suspended slightly above the top of the cork 46 to define an air space therebetween.

It is possible to vary the closure assembly of the invention without departing from the subject matter of the invention. Thus variations of the invention are to be considered within the scope of the following claims and their equivalents.

What is claimed is:

1. A closure assembly for a bottle comprising, in combination:

a bottle having a neck with a cylindrical opening through the neck defining an axis, said opening further defining a discharge outlet with a frustoconical land extending from the cylindrical opening to a planar rim surface transverse to the axis;

a primary closure in the cylindrical opening in the neck; and a secondary closure engaging the neck of the bottle, said secondary closure including a unitary metal foil member having an inside surface, "an outer surface," an outer, annular, flat rim; a frustoconical rib within the rim; and a generally planar center plate within the rib, said secondary closure further including a thermoplastic coating on the inside surface to adhere the secondary closure to the bottle rim.

2. The closure assembly of claim 1 wherein the center plate outside surface has printing thereon.

3. The closure assembly of claim 1 wherein the center plate is embossed.

4. The closure assembly of claim 1 wherein the plate remains spaced from the primary closure.

5. The closure assembly of claim 1 wherein the bottle further includes a circumferential groove around the land to at least partially provide a rim.

6. A secondary closure for a wine bottle comprising, in combination:

a unitary metal foil member having an inside surface, an outer surface, an outer, annular, flat rim, a depending frustoconical rib within the rim, and a generally planar center plate within the rib, said secondary closure further including a thermoplastic coating on the inside surface to adhere the secondary closure to the bottle, said closure having the configuration of an inverted top hat.

* * * * *